US009236686B2

(12) United States Patent
Ohyama

(10) Patent No.: US 9,236,686 B2
(45) Date of Patent: Jan. 12, 2016

(54) ELECTRICAL CONNECTOR ASSEMBLY HAVING ANTI-DISPLACEMENT SOCKET RIBS

(71) Applicant: YAZAKI CORPORATION, Minato-ku, Tokyo (JP)

(72) Inventor: Kouichi Ohyama, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/028,599

(22) Filed: Sep. 17, 2013

(65) Prior Publication Data

US 2014/0017931 A1 Jan. 16, 2014

Related U.S. Application Data

(63) Continuation of application No. PCT/JP2012/057028, filed on Mar. 19, 2012.

(30) Foreign Application Priority Data

Mar. 22, 2011 (JP) ..... 2011-062657

(51) Int. Cl.

| | |
|---|---|
| ***H01R 12/79*** | (2011.01) |
| ***H01R 13/629*** | (2006.01) |
| ***H01R 12/59*** | (2011.01) |
| ***H01R 12/62*** | (2011.01) |

(52) U.S. Cl.

CPC ..... *H01R 13/629* (2013.01); *H01R 12/592* (2013.01); *H01R 12/62* (2013.01); *H01R 12/79* (2013.01)

(58) Field of Classification Search

CPC ..... H01R 12/79; H01R 12/592

USPC ..... 439/260, 374, 483, 495, 77, 496, 490, 439/499, 492, 493

See application file for complete search history.

(56) References Cited

U.S. PATENT DOCUMENTS

| | | | | |
|---|---|---|---|---|
| 6,733,325 | B2 * | 5/2004 | Sakai et al. | 439/495 |
| 7,452,227 | B2 * | 11/2008 | Matoba et al. | 439/260 |

(Continued)

FOREIGN PATENT DOCUMENTS

| | | |
|---|---|---|
| JP | 2002-141127 A | 5/2002 |
| JP | 2002-252048 A | 9/2002 |
| JP | 2002-280104 A | 9/2002 |

(Continued)

OTHER PUBLICATIONS

The Korean office action issued on Jul. 29, 2014 in the counterpart Korean patent application. (Partial English translation also submitted.).

*Primary Examiner* — Felix O Figueroa
*Assistant Examiner* — Paul Baillargeon
(74) *Attorney, Agent, or Firm* — Marvin A. Motsenbocker; Mots Law, PLLC

(57) ABSTRACT

A connector device includes a connector and a slider to be inserted into the connector. A connector housing of the connector has a rib configured to come into contact with a position corresponding to a depression between contacts of a flat circuit body before a top end of the flat circuit body reaches a position of a top end of a terminal and guide the top end of the flat circuit body to a position higher than the top end of the terminal in a process of inserting an insertion guide portion.

6 Claims, 17 Drawing Sheets

(56) References Cited

U.S. PATENT DOCUMENTS

| | | | |
|---|---|---|---|
| 2002/0094717 | A1 | 7/2002 | Sakai et al. |
| 2002/0119696 | A1 | 8/2002 | Okamura et al. |

FOREIGN PATENT DOCUMENTS

| | | | |
|---|---|---|---|
| JP | 2005-078842 | A | 3/2005 |
| KR | 10-2007-0055205 | A | 5/2007 |

* cited by examiner

ELECTRICAL CONNECTOR ASSEMBLY HAVING ANTI-DISPLACEMENT SOCKET RIBS

CROSS REFERENCE TO RELATED APPLICATION

This application is a Continuation of PCT Application No. PCT/JP2012/057028, filed on Mar. 19, 2012, and claims the priority of Japanese Patent Application No. 2011-062657, filed on Mar. 22, 2011, the content of both of which is incorporated herein by reference.

BACKGROUND

1. Technical Field

The present invention relates to a connector device for electrically connecting a flat circuit body such as a flexible flat cable or the like.

2. Related Art

As a connector device, there have been proposed various ones that each electrically connect between a circuit on a circuit board and a flat circuit body such as a flexible flat cable (FFC), a flexible print circuit (FPC) or the like (refer to Japanese Unexamined Patent Application Publication No. 2005-78842 and Japanese Unexamined Patent Application Publication No. 2002-141127). An example related to connector devices of this kind is shown in FIG. 1 to FIG. 4.

A connector device 100 is provided with a connector 101 fixed on a circuit board (not shown) and a slider 120 to be fitted to the connector 101 by being slide-inserted as shown in FIG. 1.

The connector 101 is provided with a connector housing 102 and a plurality of terminals 110 as shown in FIG. 2. The connector housing 102 has a slider-fitted room 103, into which an insertion guide portion 122 of the slider 120 is inserted, and a plurality of terminal accommodation rooms 104 provided in parallel at a spacing in a direction orthogonal to the insertion direction of the insertion guide portion 122. The slider-fitted room 103 is opened to the outside through an insertion port 103*a*. The terminal accommodation rooms 104 are each formed so as to encompass upper, lower and back side surroundings of the slider-fitted room 103. The terminal accommodation rooms 104 are each opened to the upper, lower and back side faces of the slider-fitted room 103. In each of the terminal accommodation rooms 104 of the connector housing 102, a press-insertion wall portion 105 is provided.

The terminals 110 have first connection portions 111 connected to contacts (not shown) on the side of the circuit board and second connection portions 112 connected to contacts (not shown) of a flat circuit body 130. The first connection portions 111 are disposed in the outside of the connector housing 102. The first connection portions 111 are connected to the contacts (not shown) on the side of the circuit board by being soldered. The second connection portions 112 each have a pinching press-insertion portion 113 and a terminal contact portion 114, which are provided at a spacing to each other. The terminals 110 are each fixed to connector housing 102 in a manner that its pinching press-insertion portion 113 is press-inserted between the press-insertion wall portion 105 and an upper wall portion 102*a*. The pinching press-insertion portion 113 and the terminal contact portion 114 are disposed in the terminal accommodation room 104 at the upper and lower positions thereof and are arranged so as to oppose to each other across the slider-fitted room 103.

The terminal contact portion 114 has a contact protuberance 114*a* protruding to the side of the slider-fitted room 103. There is formed a tapered face 114*c* from the contact protuberance 114*a* to the top end 114*b*. The terminal contact portion 114 is disposed in the terminal accommodation room 104 in a state in which the contact protuberance 114*a* is protruded into the slider-fitted room 103.

The slider 120 has a slider body 121 and a pushing cover 125 for pinching the top end side of the flat circuit body 130 in between with the bottom face of the slider body 121 as shown in FIG. 3.

The slider body 121 has the insertion guide portion 122 to be inserted into the slider-fitted room 103. On the top end side of the insertion guide portion 122, there is provided a terminal pressing portion 123 protruding downward. The terminal pressing portion 123 has a tapered face 123*a* formed on the underside thereof. The flat circuit body 130 is placed along the bottom face of the slider body 121 so that the top end 130*a* (refer to FIG. 4) of the flat circuit body 130 is positioned on the rear end side of the tapered face 123*a*.

The pushing cover 125 fixes the flat circuit body 130 at a position before the contact position of the flat circuit body 130.

In the above configuration, the insertion guide portion 122 of the slider 120 is inserted into the slider-fitted room 103 from the insertion port 103*a* of the connector 101. Then, as shown in FIG. 4A, the tapered face 123*a* of the terminal pressing portion 123 impinges to the contact protuberance 114*a* of the terminal 110 protruding into the slider-fitted room 103, and the terminal contact portion 114 is elastically deformed backward in the terminal accommodation room 104 by the pressing force, which allows insertion of the insertion guide portion 122. The terminal contact portion 114 is gradually displaced backward in the terminal accommodation room 104 in following to the tapered face 123*a* of the terminal pressing portion 123. Further, even if the top end 130*a* of the flat circuit body 130 hangs down to an extent with respect to the bottom face of the insertion guide portion 122, the tapered face 123*a* of the terminal pressing portion 123 picks up the top end 130*a* of the flat circuit body 130 and slides on the undersurface of the flat circuit body 130. Upon insertion of the insertion guide portion 122 up to the position of insertion completion, the contact protuberance 114*a* of the terminal contact portion 114 comes into press contact with the contact (not shown) of the flat circuit body 130 by means of an elastic recovery force.

SUMMARY

Incidentally, since mounted on a circuit board (not shown) through reflow soldering, the connector 101 is exposed under high temperature environment at the occasion. Since the connector housing 102 is made of synthetic resin, the connector housing 102 has a fear of being spherically deformed when exposed under high temperature environment. This spherical deformation due to heat normally becomes such a deformation that the upper wall portion 102*a* of the connector housing 102 is warped upward as shown with imaginary lines in FIG. 2, and the terminal 110 is displaced so as to follow this deformation. That is, the top end side of the terminal 110 is displaced upward (direction of arrow AR 2 in FIG. 2) by that the rear end portion of the upper wall portion 102*a* pushes the rear end portion of the terminal 110 downward (direction of arrow AR 1 in FIG. 2) and the terminal 110 rotates about the press-insertion wall portion 105 as a fulcrum. When the terminal 110 is displaced from the normal position like this, the top end 114*b* of the terminal contact portion 114 comes out from the terminal accommodation room 104 to be positioned in the slider-fitted room 103 as shown in FIG. 4B. Then, such a problem may be brought about that the top end 114*b* of the terminal contact portion 114 impinges to the top end 130*a* of the flat circuit body 130 before the terminal pressing portion 123 of the insertion guide portion 122 comes into contact with the terminal contact portion 114, and the flat circuit body 130, terminal 110, and the like are deformed and/or damaged to possibly cause poor contact.

Particularly, with advance of miniaturization of connector devices 100, it becomes difficult to have a dimensional margin in which a safety factor is taken into account with respect to dimensional relationship between the terminal 110 and the connector housing 102, so it is desperately desired that such poor contact as described above will be prevented.

Here, it is thought that, as shown with solid lines in FIG. 5, the height h of the terminal accommodation room 104 is rendered to be higher than that of the related example described above (shown with imaginary lines in FIG. 5), and the top end 114*b* of the terminal contact portion 114 is prevented from protruding into the slider-fitted room 103. However, if the structure like this is adopted, the width dimension W of the slider-fitted room 103 becomes smaller by the amount of rendering the terminal accommodation room 104 higher. The width dimension W of the slider-fitted room 103 thereby becomes equal to or less than the thickness T of the insertion guide portion 122 of the slider 120 (including the thickness of the flat circuit body 130) to cause fitting failure; accordingly, this structure cannot be adopted.

Likewise, it is also thought that, as shown with solid lines in FIG. 6, the height position of the top end 114*b* of the terminal contact portion 114 is rendered to be lower than that of the related example described above (shown with imaginary lines in FIG. 6), and the top end 114*b* of the terminal contact portion 114 is prevented from protruding into the slider-fitted room 103. However, if the structure like this is adopted, the terminal contact portion 114 comes into contact with the bottom face of the terminal accommodation room 104 at the occasion of fitting the slider 120, and an appropriate state of being in contact is not obtained; accordingly; this structure cannot also be adopted.

An object of the present invention is to provide a connector device having a high degree of fitting reliability, with which it is possible to bring a flat circuit body and a terminal reliably in contact with each other even in the case in which the top end of a terminal contact portion protrudes into a slider-fitted room.

An aspect of the present invention is a connector device including: a connector including a connector housing having a slider-fitted room and a terminal accommodation room with an opening toward the slider-fitted room, and a contact having a terminal contact portion accommodated elastically deformably in the terminal accommodation room and protruding into the slider-fitted room; and a slider including an insertion guide portion to be inserted into the slider-fitted room, a terminal pressing portion provided on a top end side of the insertion guide portion and configured to press the terminal contact portion in a direction toward a back of the terminal accommodation room to deform the terminal contact portion elastically in a process of inserting the insertion guide portion, and a flat circuit body having contacts placed at an insertion position rearward with respect to the terminal pressing portion and to be brought to come into contact with the terminal contact portion at a fitting position by an elastic recovery force of the terminal contact portion. The connector housing has a rib configured to come into contact with a position corresponding to a depression between the contacts of the flat circuit body before a top end of the flat circuit body reaches a position of a top end of the terminal and guide the top end of the flat circuit body to a position higher than the top end of the terminal in the process of inserting the insertion guide portion.

The top end side of the rib may be a tapered face gradually becoming higher toward an insertion direction of the insertion guide portion.

According to the above configuration, when the insertion guide portion of the slider is inserted into the slider-fitted room, the rib comes in the depression portion in the top end of the flat circuit body before the top end of the flat circuit body reach the position of the top end of the terminal, and the top end side of the flat circuit body is inserted while being positioned higher than the top end of the terminal by being guided by the rib. For this reason, even in the case in which the top end of the terminal contact portion protrudes into the slider-fitted room, such a situation in which the top end of the terminal contact portion impinges to the top end of the flat circuit body does not arise. Accordingly, even in the case in which the top end of the terminal contact portion protrudes into the slider-fitted room, the flat circuit body and the terminal can be reliably in contact with each other, and a connector device having high reliability on fitting can be provided.

BRIEF DESCRIPTION OF DRAWINGS

FIG. 4 show the related example.

FIG. 8 show the embodiment of the present invention.

FIG. 9 show the embodiment of the present invention.

FIG. 12 show the embodiment of the present invention.

FIG. 14 show the embodiment of the present invention.

FIG. 18 show the embodiment of the present invention.

DETAILED DESCRIPTION

An embodiment of the present invention will be described below on the basis of the drawings.

Figure 1:
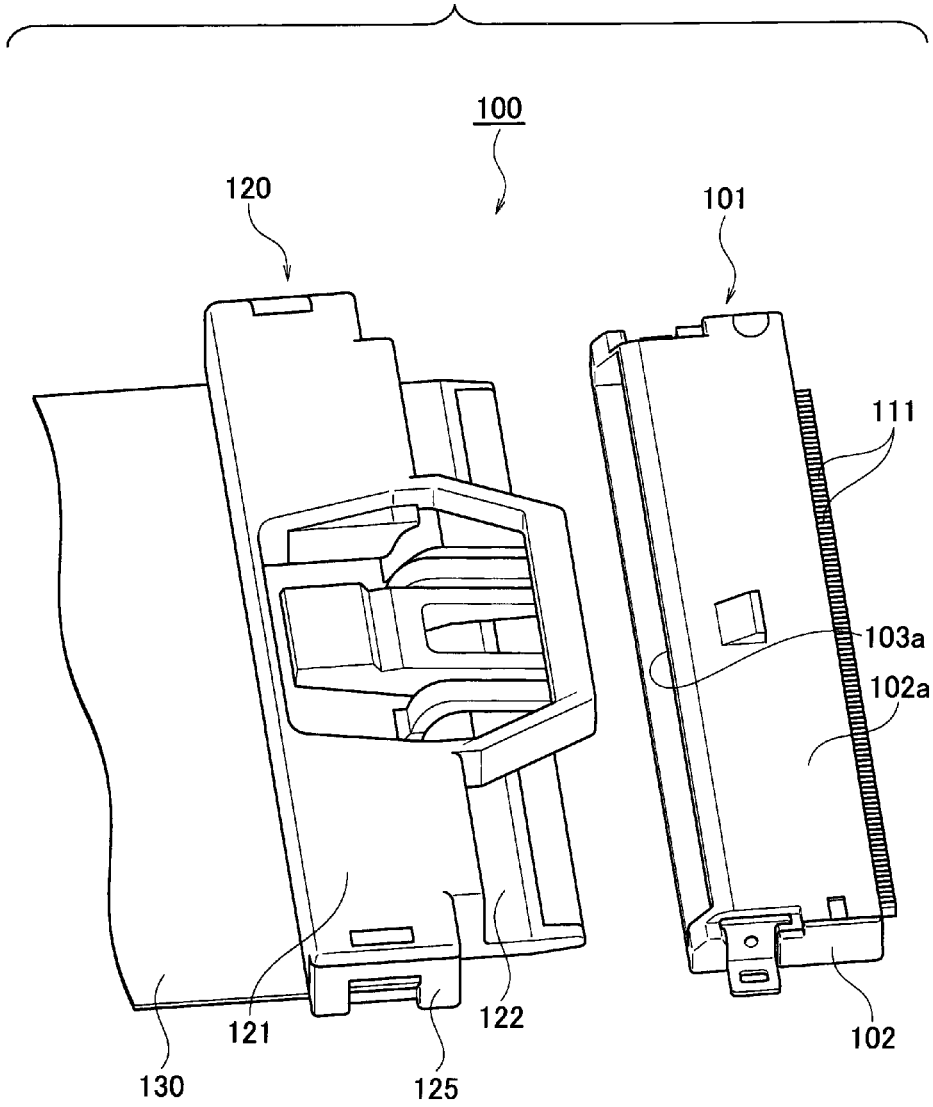
FIG. 1 RELATED ART
FIG. 1 is a perspective view of a connector device, showing a related example.
Figure 2:
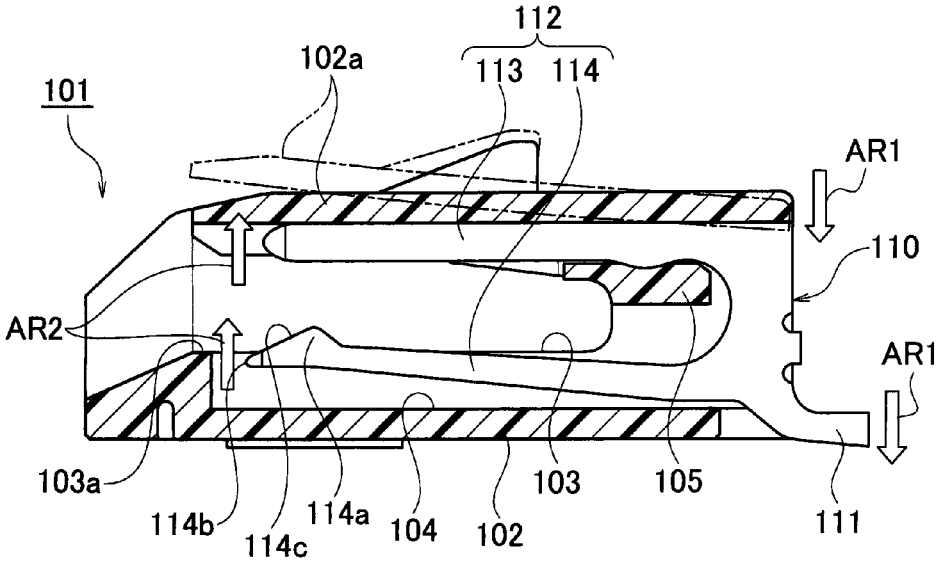
FIG. 2 RELATED ART
FIG. 2 is a cross-sectional view of a connector, showing the related example.
Figure 3:
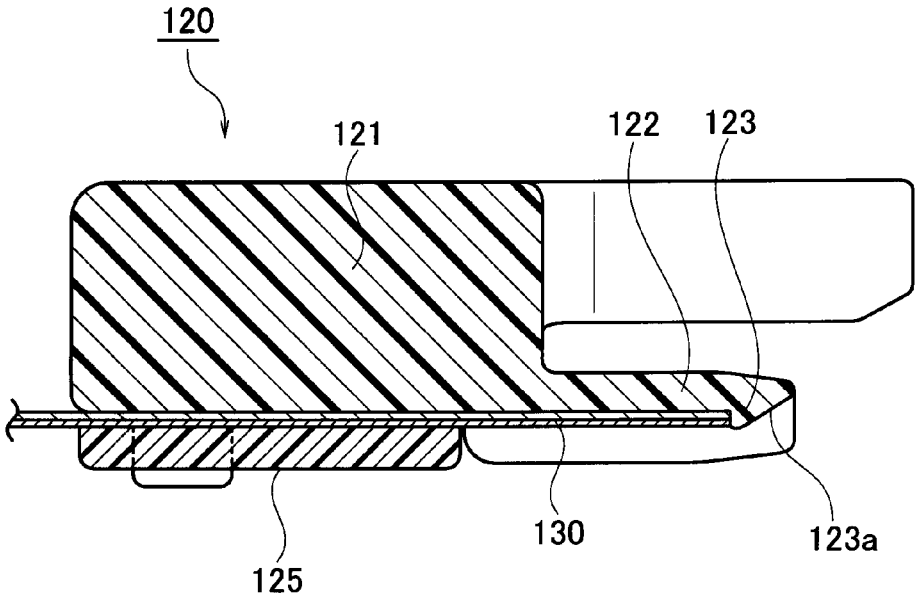
FIG. 3 RELATED ART
FIG. 3 is a cross-sectional view of a slider, showing the related example.
Figure 4A:
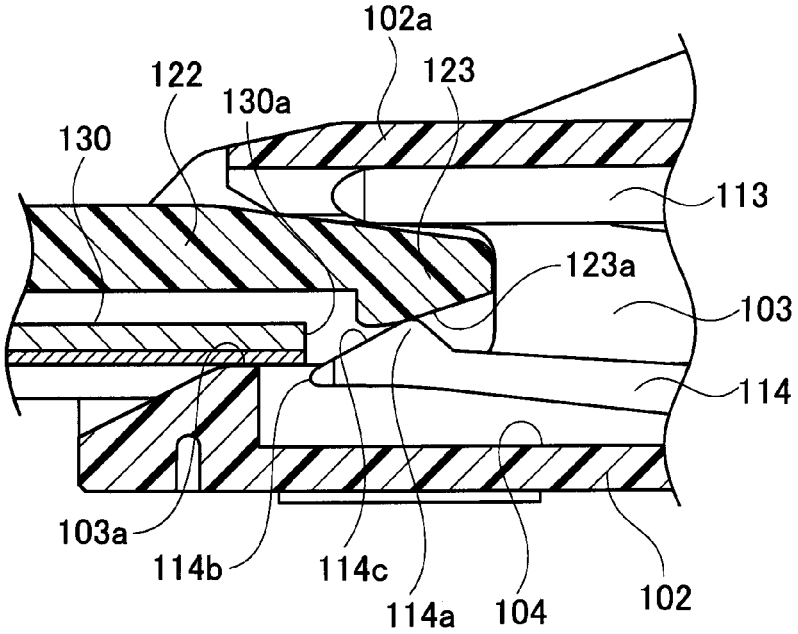
FIG. 4A RELATED ART
FIG. 4A is a cross-sectional view of a main portion showing a process of inserting the insertion guide portion of a slider into the slider-fitted room of the connector in the case in which the top end of a terminal contact portion is positioned in a terminal accommodation room.
Figure 4B:
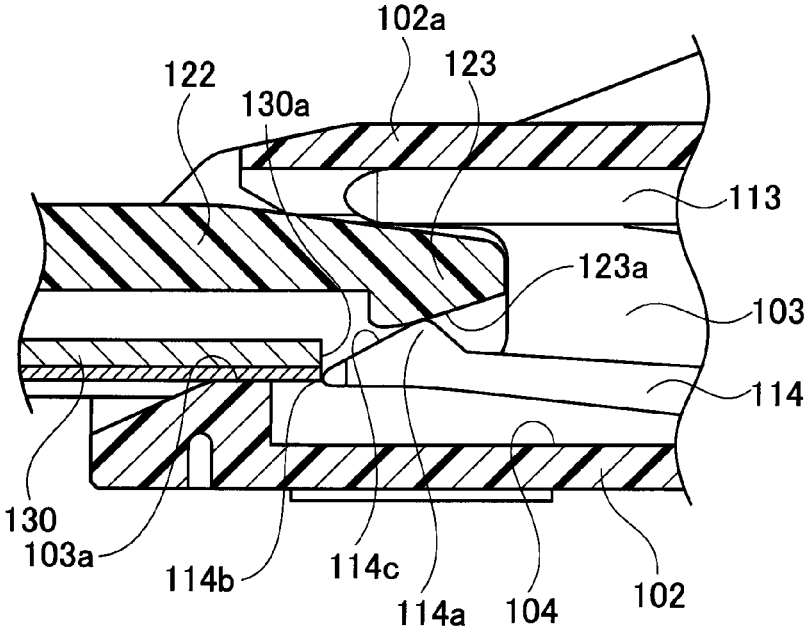
FIG. 4B RELATED ART
FIG. 4B is a cross-sectional view of a main portion showing a process of inserting the insertion guide portion of a slider into the slider-fitted room of the connector in the case in which the top end of a terminal contact portion protrudes into the slider-fitted room.
Figure 5:
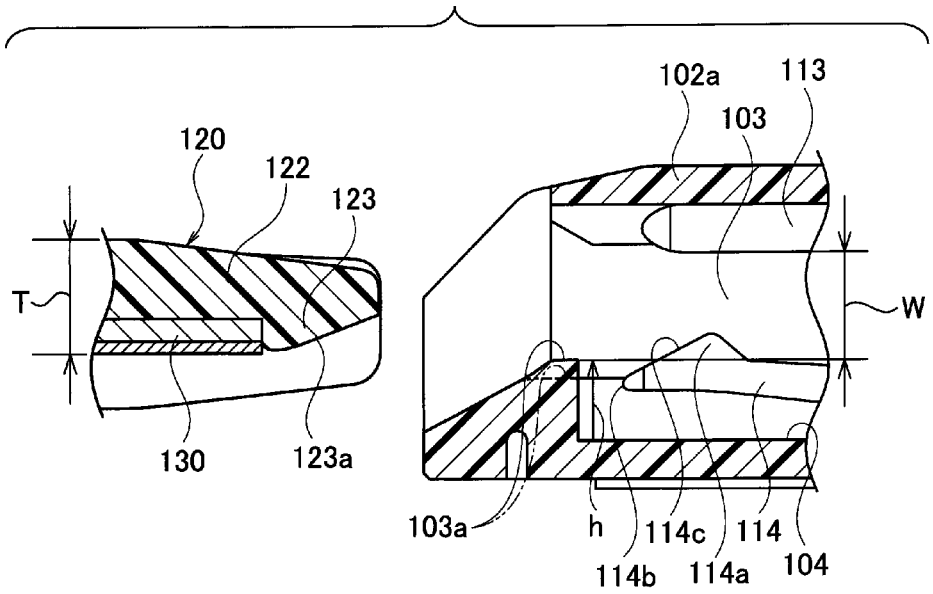
FIG. 5 RELATED ART
FIG. 5 is a cross-sectional view of a main portion of a connector device, the height of the terminal accommodation room of which is rendered to be higher than that of the related example, before the slider is fitted to the connector.
Figure 6:
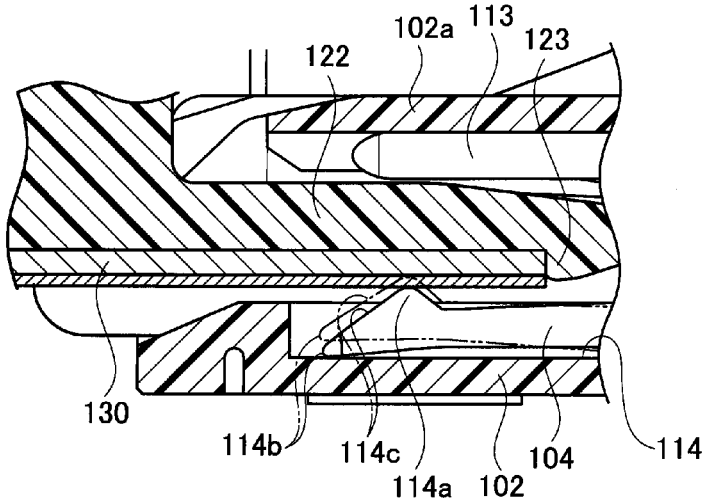
FIG. 6 RELATED ART
FIG. 6 is a cross-sectional view of a main portion of a connector device, the top end position of the terminal contact portion of which is rendered to be lower than that of the related example, showing a state of fitting the slider to the connector.
Figure 7:
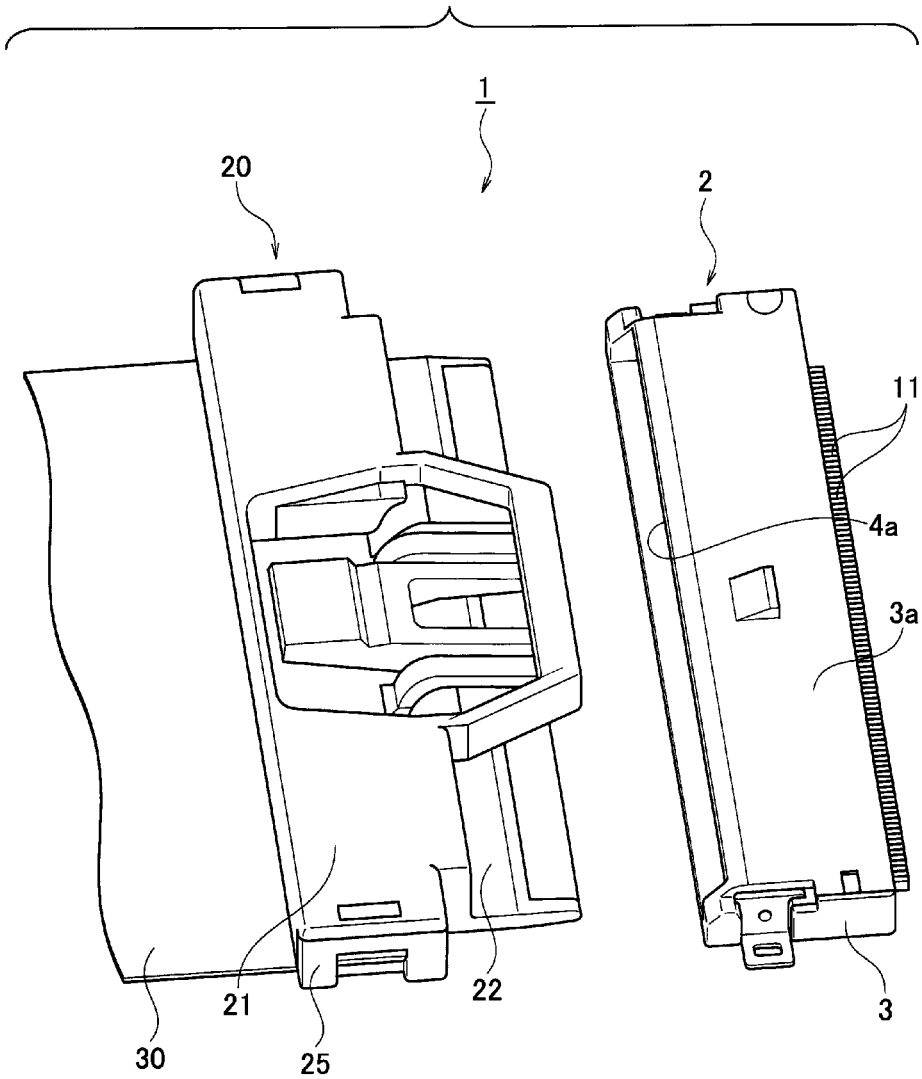
FIG. 7 is a perspective view of a connector device, showing an embodiment of the present invention.

FIG. 7 to FIG. 18 show the embodiment of the present invention. A connector device 1 is provided with a connector 2 fixed on a circuit board (not shown) and a slider 20 to be fitted to the connector 2 by being slide-inserted as shown in FIG. 7.

Figure 8A:
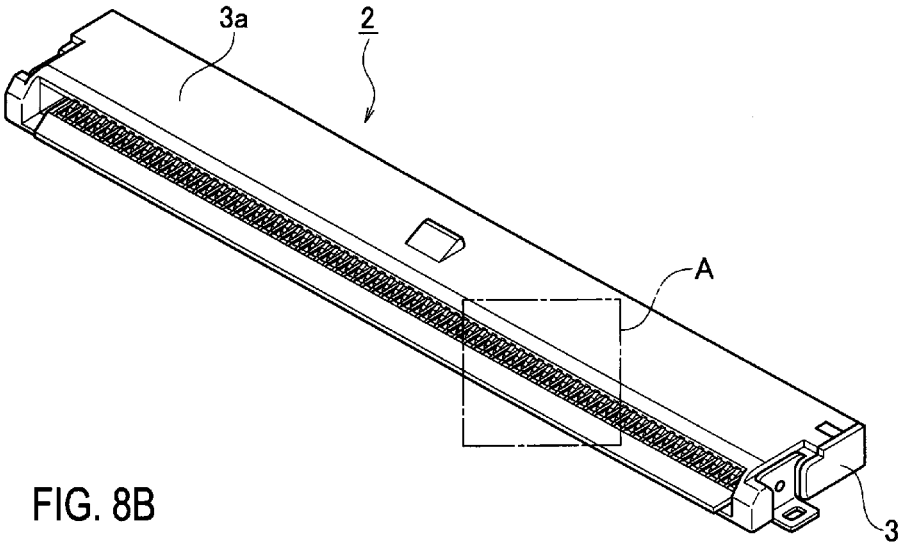
FIG. 8A is a perspective view of a connector.
Figure 8B:
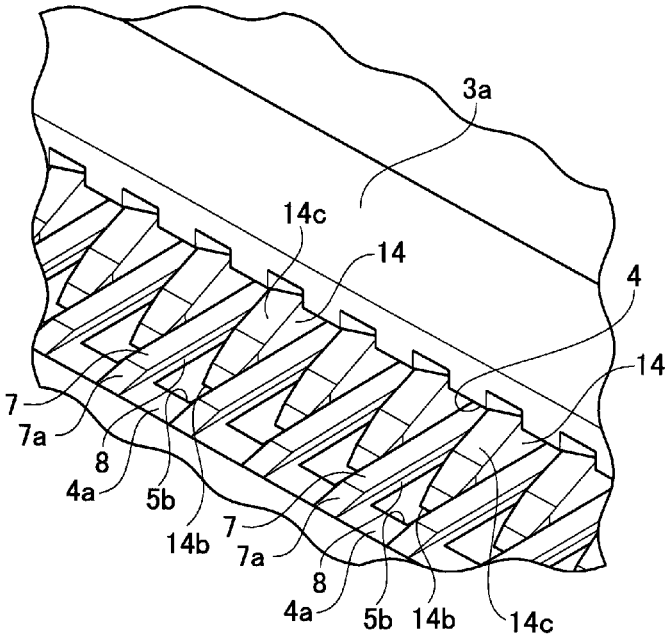
FIG. 8B is an enlarged view of part A of FIG. 8A.
Figure 9A:
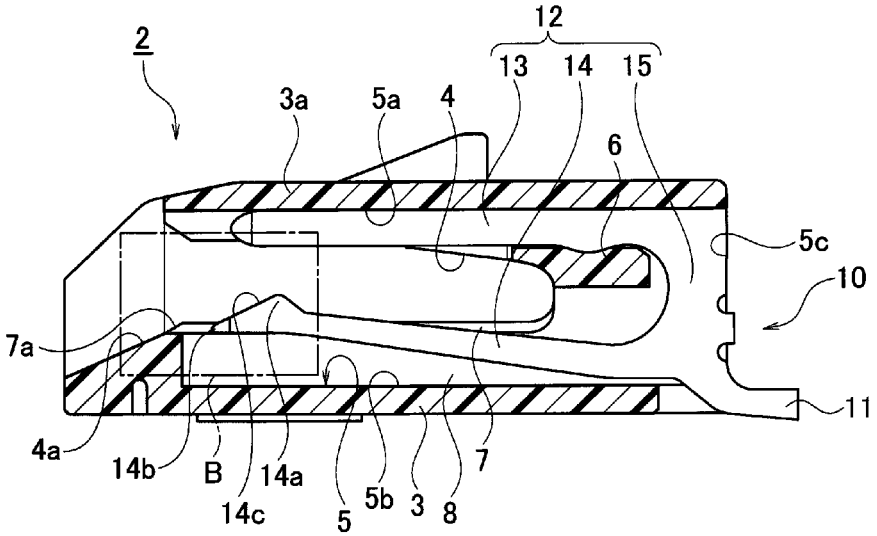
FIG. 9A is a cross-sectional view of the connector.
Figure 9B:
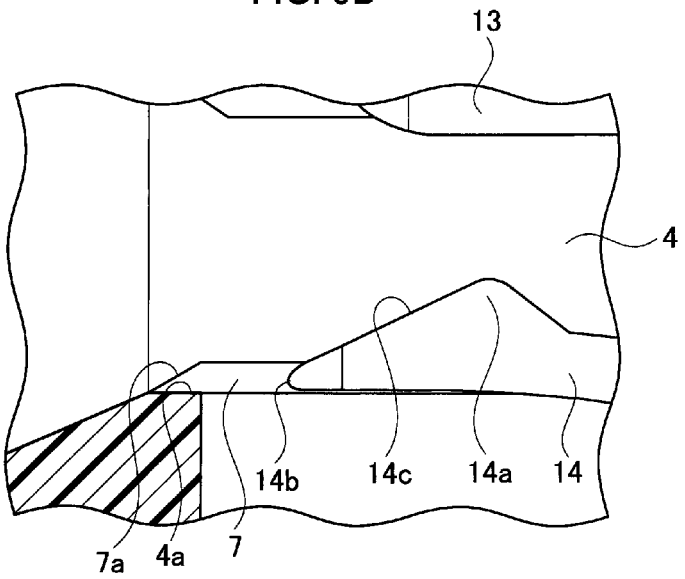
FIG. 9B is an enlarged view of part B of FIG. 9A.
Figure 10:
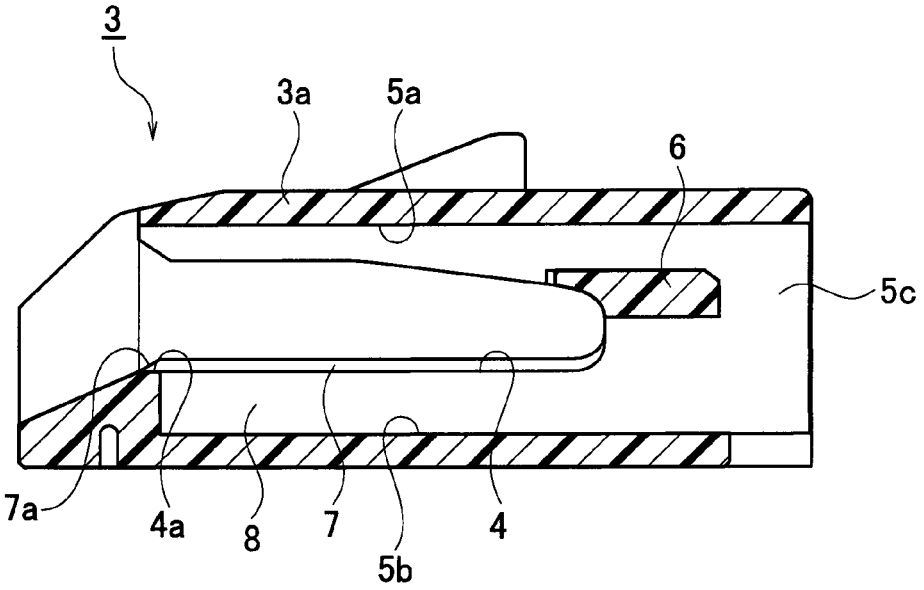
FIG. 10 is a cross-sectional view of a connector housing, showing the embodiment of the present invention.

The connector 2 is provided with a connector housing 3 and a plurality of terminals 10 as shown in FIG. 8 to FIG. 10. The connector housing 3 is formed of an insulative synthetic resin material. The connector housing 3 has a slider-fitted room 4, into which an insertion guide portion 22 of the slider 20, and a plurality of terminal accommodation rooms 5 provided in parallel at a spacing in a direction orthogonal to the insertion direction of the insertion guide portion 22. On the front side of the slider-fitted room 4, an insertion port 4*a* is formed. The terminal accommodation rooms 5 are each formed so as to encompass upper, lower and back side surroundings of the slider-fitted room 4. Each of the terminal accommodation rooms 5 is constituted of an upper accommodation room 5*a* positioned above the slider-fitted room 4, a lower accommodation room 5*b* positioned below the slider-fitted room 4, and a base-portion accommodation room 5*c* connecting thereof. The upper accommodation room 5*a* and the lower accommodation room 5*b* are opened to the upper and lower faces of the slider-fitted room 4, respectively.

In the connector housing 3, there is provided a press-insertion wall portion 6 passing through the base-portion accommodation room 5*c* of the terminal accommodation room 5.

In the connector housing 3, there are provided ribs 7 on the upper faces of partition wall portions 8 for adjacent lower accommodation rooms 5*b*, i.e., at the positions corresponding with depressed portions 32 in between contacts 31 of a flat circuit body 30, respectively. The ribs 7 are each arranged across from the insertion port 4*a* to the backmost position of the slider-fitted room 4. The ribs 7 thereby each come into contact with the flat circuit body 30 before the top end 30*a* of the flat circuit body 30 reach the position of the top end 14*b* of each of the terminals 10, and guide the top end 30*a* of the flat circuit body 30 to a position higher than the top end 14*b* of a terminal contact portion 14. Specifically, the height of a contact 31 at the top end 30*a* of the flat circuit body 30 is set so as to guide it to a position higher than the top end 14*b* of the terminal contact portion 14 even in the case in which the top end 14*b* of the terminal contact portion 14 protrudes into the slider-fitted room 4. The height dimension of each of the ribs 7 is set greater than the depth dimension of the depressed portion 32 of the flat circuit body 30. The top end side of each of the ribs 7 is formed as a tapered face 7*a*, the height of which is increased gradually toward the insertion direction of the insertion guide portion 22.

The terminal 10 is formed of an electrically conductive metal plate as shown in FIGS. 9A, 9B. The terminal 10 has a first connection portion 11 connected to a contact (not shown) on the side of the circuit board and a second connection portion 12 to be connected to the contact 31 of the flat circuit body 30. The first connection portion 11 is disposed outside the connector housing 3. The first connection portion 11 is connected to the contact (not shown) on the side of the circuit board by being soldered. The second connection portion 12 has a pinching press-insertion portion 13 and the terminal contact portion 14, which are provided at a spacing to each other, and a joining base portion 15 joining thereof.

The pinching press-insertion portion 13 and the terminal contact portion 14 are disposed in an upper accommodation room 5*a* and a lower accommodation room 5*b*, respectively. The pinching press-insertion portion 13 and the terminal contact portion 14 are thereby arranged so as to oppose to each other with the slider-fitted room 4 therebetween. The pinching press-insertion portion 13 is pressed in between the press-insertion wall portion 6 and an upper wall portion 3*a*. The terminal 10 is fixed to the connector housing 3 by means of this pressing-in force. The terminal contact portion 14 has a contact protuberance 14*a*, which protrudes to the side of the slider-fitted room 4. A tapered face 14*c* is formed from the contact protuberance 14*a* to the top end 14*b*. The terminal contact portion 14 is normally is arranged in the lower accommodation room 5*b* of the terminal accommodation rooms 5 in the state in which the contact protuberance 14*a* is protruded into the slider-fitted room 4. The joining base portion 15 is placed in the base-portion accommodation room 5*c*.

Figure 11:
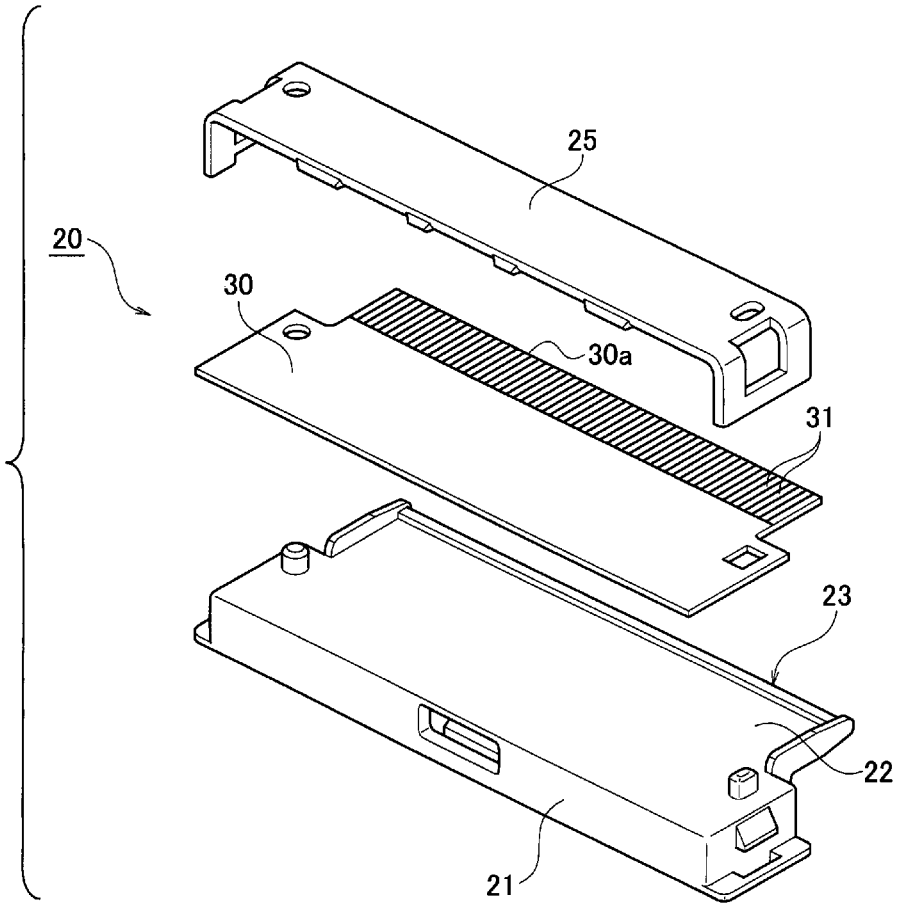
FIG. 11 is an exploded perspective view of a slider as seen from the bottom face side, showing the embodiment of the present invention.
Figure 12A:
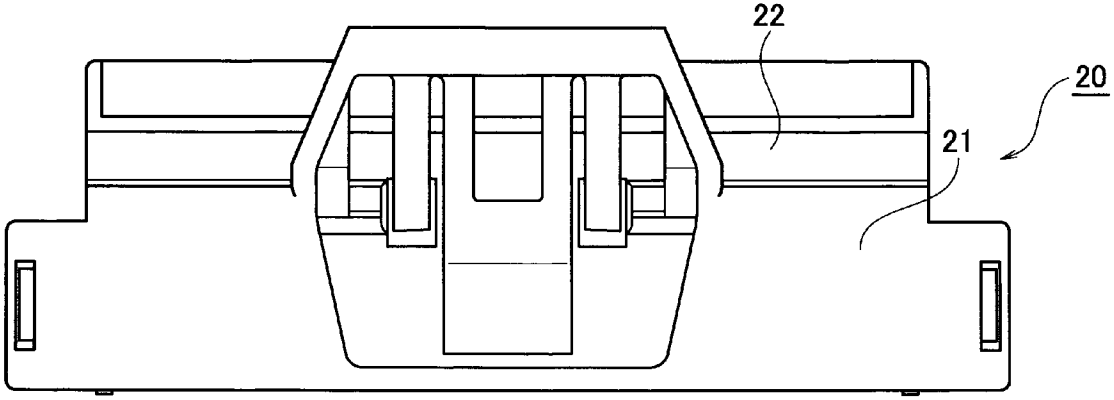
FIG. 12A is a plan view of the slider.
Figure 12B:
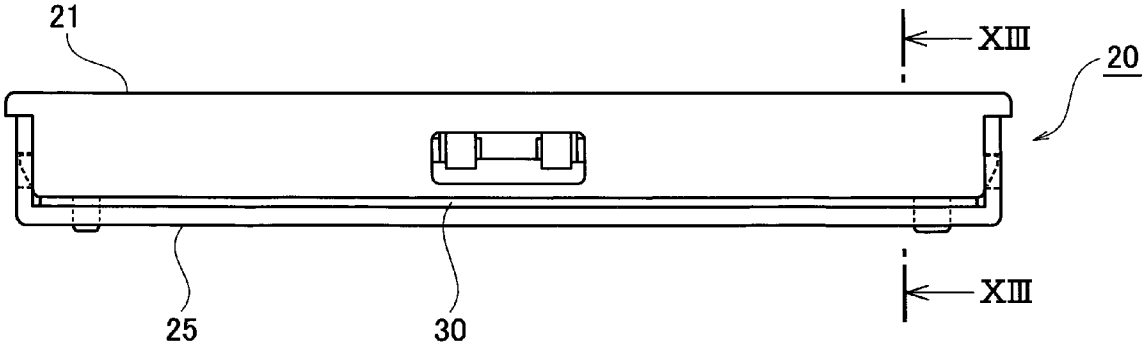
FIG. 12B is an elevation view of the slider.
Figure 13:
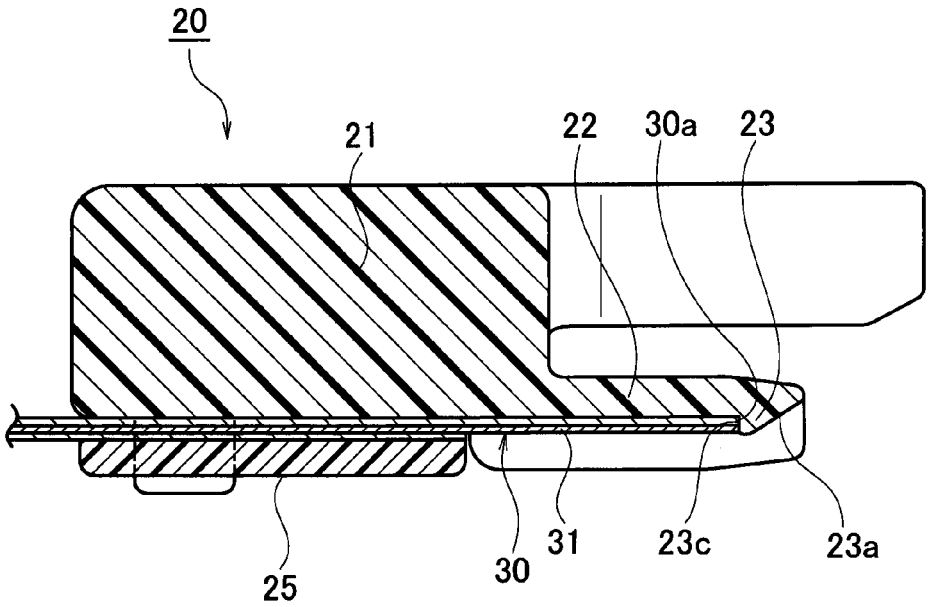
FIG. 13 is a cross-sectional view taken from line XIII-XIII of FIG. 12B, showing the embodiment of the present invention.

The slider 20 has a slider body 21 and a pushing cover 25 for pinching the top end side of the flat circuit body 30 in between the bottom face of the slider body 21 as shown in FIG. 11 to FIG. 13.

The slider body 21 has the insertion guide portion 22 to be inserted into the slider-fitted room 4. On the top end side of the insertion guide portion 22, there is provided a terminal pressing portion 23 protruding downward. The terminal pressing portion 23 presses the terminal contact portion 14 in the process of inserting the insertion guide portion 22 into the slider-fitted room 4. The bottom face of the terminal pressing portion 23 is formed as a tapered face 23*a*, which is inclined in a direction that causes the elastic displacement amount of the terminal contact portion 14 to be increased gradually from the top end side of insertion toward the rear of insertion.

The flat circuit body 30 is a highly flexible flat-shaped circuit body. The flat circuit body 30 is a flexible flat cable (FFC), a flexible print circuit (FPC) or the like. The top end side of the flat circuit body 30 is placed on the bottom face of the slider body 21 and also on the rear end side of the terminal pressing portion 23. Specifically, at the rear end of the terminal pressing portion 23, a stepped face 23*c* is formed in between with the bottom face of the slider body 21 as shown in FIG. 13. The top end 30*a* of the flat circuit body 30 is disposed so as to follow the stepped face 23*c*.

Figure 14A:
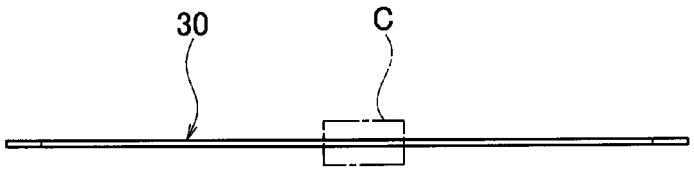
FIG. 14A is an elevation view of a flat circuit body.
Figure 14B:
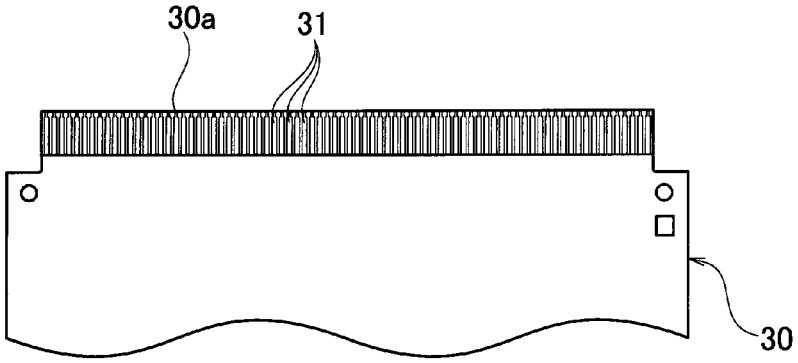
FIG. 14B is a bottom plan view of the flat circuit body.
Figure 14C:
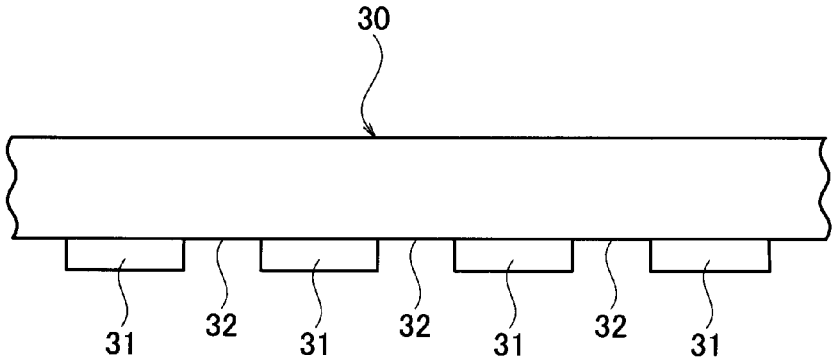
FIG. 14C is an enlarged view of part C of FIG. 14A.

On the top end side of the flat circuit body 30, there are provided a plurality of contacts 31 aligned in parallel at a spacing in the width direction as shown in FIGS. 14A to 14C. The plurality of contacts 31 is constituted by exposing an electric current carrying pattern. Between respective pairs of the plurality of contacts 31, there are formed depressed portions 32 that are made by stripping an insulation layer in order to expose the contacts 31.

The pushing cover 25 fixes the flat circuit body 30 at a position before the position of the contacts 31 of the flat circuit body 30.

Figure 15:
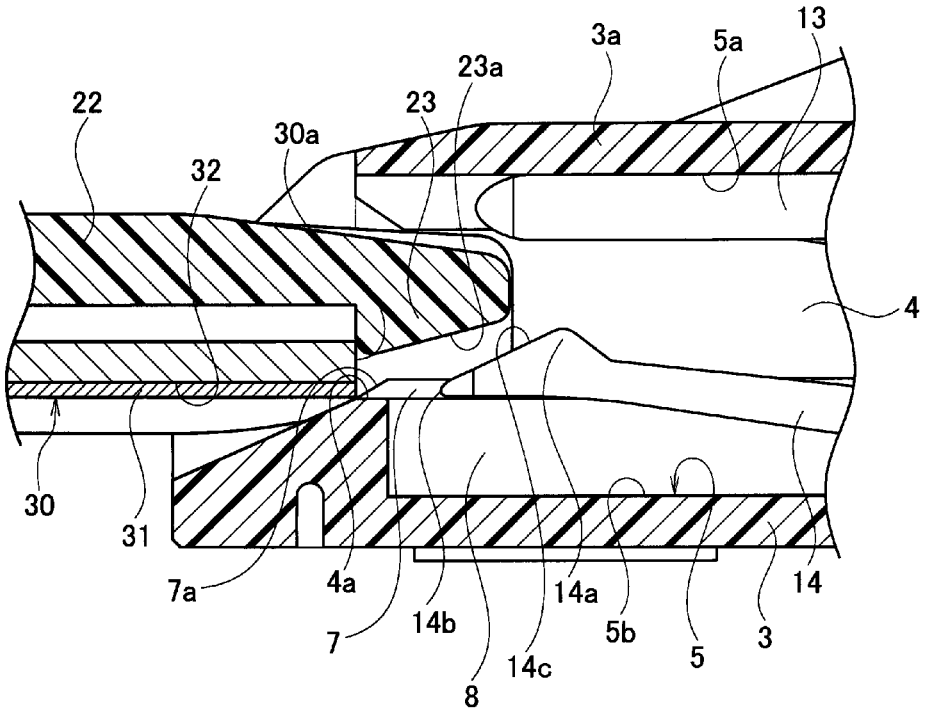
FIG. 15 is a cross-sectional view of a main portion showing a process of inserting the insertion guide portion of the slider into the slider-fitted room of the connector, showing the embodiment of the present invention.

Next, the action of fitting the slider 20 to the connector 2 will be described. The insertion guide portion 22 of the slider 20 is inserted from the insertion port 4*a* of the connector 2 into the slider-fitted room 4. Then, the insertion guide portion 22 comes in between the pinching press-insertion portion 13 and the terminal contact portion 14 of the terminal 10 as shown in FIG. 15. Then, the ribs 7 come first in the depressed portions 32 at the top end of the flat circuit body 30, respectively, and the top end side of the flat circuit body 30 is inserted as being guided to a position higher than the top end 14*a* of the terminal 10 by being guided by the respective ribs 7. Here, since being placed at the positions corresponding to the respective depressed portions 32 of the flat circuit body 30, the respective ribs 7 do not come into contact with the contacts 31 of the flat circuit body 30.

Figure 16:
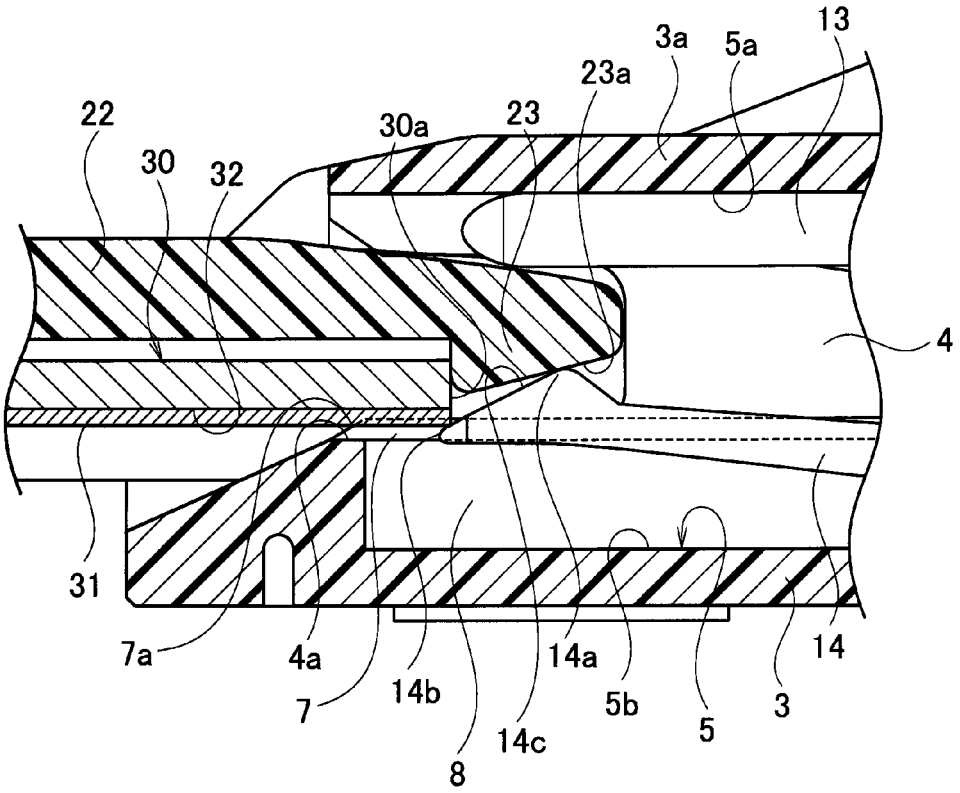
FIG. 16 is a cross-sectional view of a main portion showing a process of inserting the insertion guide portion of the slider into the slider-fitted room of the connector, showing the embodiment of the present invention.

When the insertion of the insertion guide portion 22 is advanced, the tapered face 23*a* of the terminal pressing portion 23 comes into contact with the contact protuberance 14*a* of the terminal 10 protruding into the slider-fitted room 4 as shown in FIG. 16, and the terminal contact portion 14 is elastically deformed backward in the terminal accommodation room 5 by the pressing force, which allows insertion of the insertion guide portion 22. The terminal contact portion 14 is gradually displaced backward in the terminal accommodation room 5 in following to the tapered face 23*a* of the terminal pressing portion 23. Accordingly, even if the top end 30*a* of the flat circuit body 30 hangs down to an extent with respect to the bottom face of the insertion guide portion 22, the tapered face 23*a* of the terminal pressing portion 23 comes in underneath the flat circuit body 30 without impinging to the top end 30*a* of the flat circuit body 30.

Figure 17:
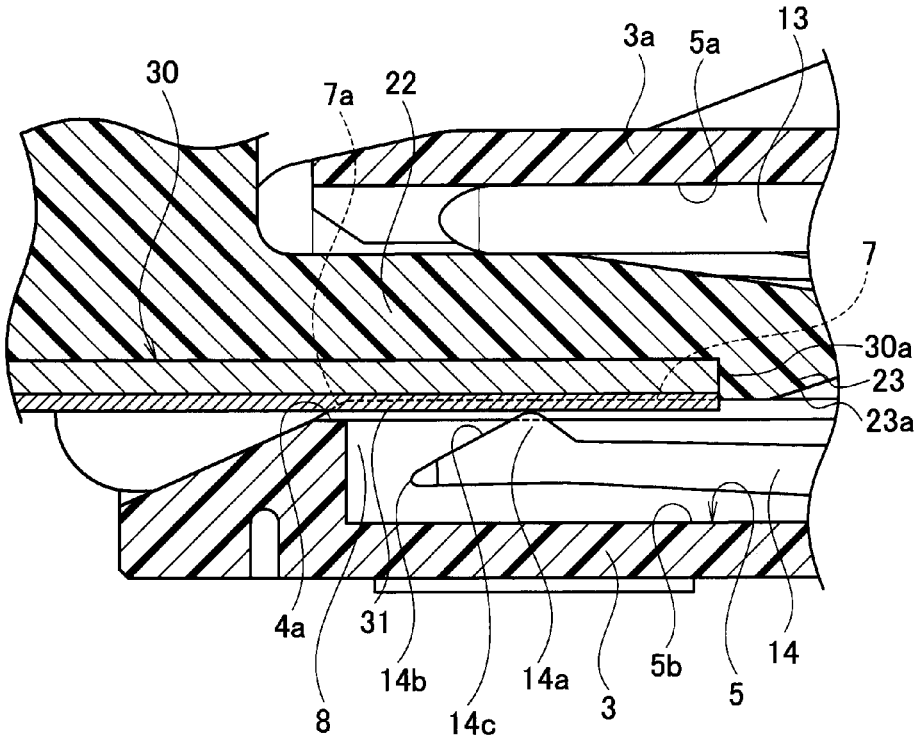
FIG. 17 is a cross-sectional view of a main portion showing the completion state of fitting the slider to the connector, showing the embodiment of the present invention.
Figure 18A:
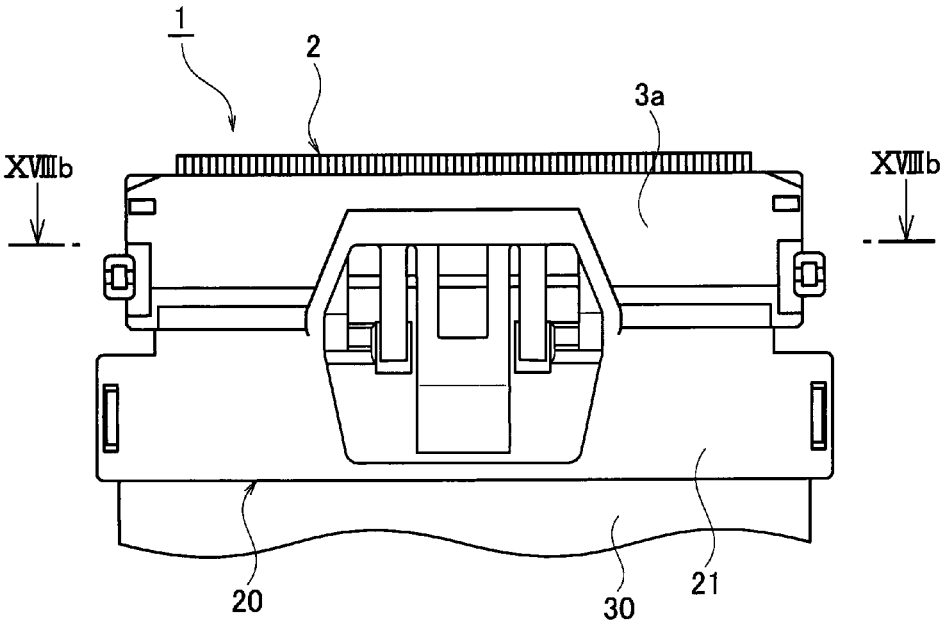
FIG. 18A is a plan view showing the completion state of fitting the slider to the connector.
Figure 18B:
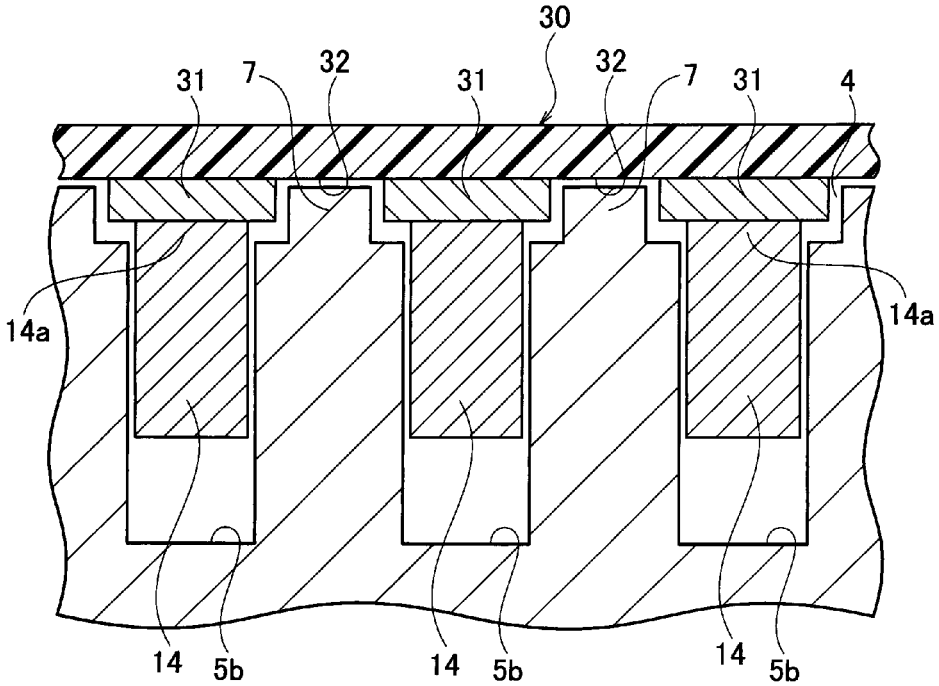
FIG. 18B is an enlarged cross-sectional view of a main portion taken from line XVIIIb-XVIIIb of FIG. 18A.

As shown in FIG. 17, upon insertion of the insertion guide portion 22 up to the position of insertion completion, the contact protuberance 14*a* of the terminal contact portion 14 is positioned to oppose to the contact 31 of the flat circuit body 30, and the contact protuberance 14*a* of the terminal contact portion 14 comes into press contact with the contact 31 of the flat circuit body 30 by means of an elastic recovery force.

In the action of fitting described above, a situation may happen in which the top end 14*b* of the terminal contact portion 14 of the terminal 10 protrudes into the slider-fitted room 4 due to thermal deformation of the connector housing 3, or the like. Even in the case like this, when the insertion guide portion 22 of the slider 20 is inserted from the insertion port 4*a* into the slider-fitted room 4, the rib 7 begins to come into contact with the flat circuit body 30 before the top end 30*a* of the flat circuit body 30 reaches the position of the top end 14*b* of the terminal 10 as shown in FIG. 15, and the top end 30*a* of the flat circuit body 30 is inserted while being positioned higher than the top end 14*b* of the terminal contact portion 14 by being guided by the rib 7. Accordingly, even in the case in which the top end 14*b* of the terminal contact portion 14 protrudes into the slider-fitted room 4, such a situation in which the top end 14*b* of the terminal contact portion 14 impinges to the top end 30*a* of the flat circuit body 30 does not arise, but the top end 14*b* of the terminal contact portion 14 comes in underneath the flat circuit body 30. From the above, even in the case in which the top end 14*b* of the terminal contact portion 14 protrudes into the slider-fitted room 4, the flat circuit body 30 and the terminal 10 can be reliably in contact with each other, which provides high reliability on fitting.

The top end side of the rib is formed as the tapered face 7*a*, the height of which is increased gradually toward the insertion direction of the insertion guide portion 22. The top end 30*a* of the flat circuit body 30 can therefore be smoothly guided to the above of the slider-fitted room 4 without undergoing any damage.

The rib 7 is mounted in between the adjacent terminal accommodation rooms 5. This mounting position is a place where is easy to secure the mount space in the connector housing 3. Accordingly, since it is possible to realize a configuration in which a safety factor is taken into account with respect to dimensional relationship between the terminal 10 and the connector housing 3, even though miniaturization of the connector device 100 is advanced, it is possible to have a dimensional margin in which a safety factor is taken into account with respect to dimensional relationship between the terminal 10 and the connector housing 3, so high reliability on fitting can be ensured.

Although the terminal 10 is such one that has the pinching press-insertion portion 13 and the terminal contact portion 14, which are provided at a spacing to each other, and brings the terminal contact portion 14 to comes into press contact with the flat circuit body 30 through pinching the insertion guide portion 22 of the slider 20 between the pinching press-insertion portion 13 and the terminal contact portion 14, it is not limited thereto. The terminal 10 may be allowed as long as it brings the terminal contact portion 14 to come into press contact with the flat circuit body 30 by means of its elastic recovery force.

Although an embodiment of the present invention has been described above, the present invention is not limited to the above embodiment, but various modifications thereof are possible.

What is claimed is:

1. A connector assembly comprising:

a connector including a connector housing having a slider socket opening in a slider insertion port, and terminal accommodation chambers each opening on the slider socket, and connector terminals each accommodated elastically deformably in a respective one of the terminal accommodation chambers, and having, in a tip end thereof, a terminal-contact portion protruding into the slider socket; and a slider including a slider insertion guide portion for being inserted into the slider socket, a terminal pressing portion provided along a leading edge of the insertion guide portion and configured to press the terminal-contact portions depth-ward in the terminal accommodation chambers to deform the terminal-contact portions elastically in a process of the insertion guide portion being inserted into the slider socket, and a flat circuit element disposed with a leading edge thereof insertion-rearward of the terminal pressing portion of the slider, and the flat circuit element having a base and, rising from a surface of the base along the leading edge, contacts for, with the slider being plugged into the connector, being pressed on by the terminal-contact portions of the connector terminals under elastic recovery force of the terminal-contact portions, the contacts being separated by inter-contact depressions; wherein the connector housing has ribs in between the terminal accommodation chambers, the ribs having tip ends extending to the slider insertion port and configured so as, in the process of the slider insertion guide portion being inserted into the slider socket, to come into tip-end contact with the surface of the base of the flat circuit element at the inter-contact depressions before the leading edge of the flat circuit element reaches the tip ends of the terminal-contact portions of the connector terminals, and guide the leading edge of the flat circuit element to a position higher than the tip ends of the terminal-contact portions.

2. The connector assembly according to claim 1, wherein the tip ends of the ribs are each a tapered face sloping toward the slider insertion port.

3. The connector assembly according to claim 1, wherein the ribs stand taller than the inter-contact depressions in the flat circuit element are deep.

4. The connector assembly according to claim 1, wherein the connector further includes a pushing cover provided above the flat circuit element.

5. The connector assembly according to claim 1, wherein the tip ends of the terminal-contact portions of the connector terminals each have a contact protuberance for pressing on the flat-circuit-element contacts, with the slider being plugged into the connector.

6. The connector assembly according to claim 5, wherein the connector terminals each have a press-insertion portion provided opposing the terminal-contact portion, the press-insertion portion not including a contact protuberance on an end region thereof.

* * * * *